US009249546B2

(12) United States Patent
Han

(10) Patent No.: US 9,249,546 B2
(45) Date of Patent: Feb. 2, 2016

(54) FLOOR SLAB STRUCTURE FOR BRIDGE

(75) Inventor: Man-Yop Han, Yongin-si (KR)

(73) Assignee: INCT Co., Ltd., Seoul (KR)

( * ) Notice: Subject to any disclaimer, the term of this patent is extended or adjusted under 35 U.S.C. 154(b) by 6 days.

(21) Appl. No.: 13/877,146

(22) PCT Filed: Sep. 29, 2011

(86) PCT No.: PCT/KR2011/007205

§ 371 (c)(1),
(2), (4) Date: Mar. 29, 2013

(87) PCT Pub. No.: WO2012/044097

PCT Pub. Date: Apr. 5, 2012

(65) Prior Publication Data

US 2014/0109325 A1 Apr. 24, 2014

(30) Foreign Application Priority Data

Sep. 30, 2010 (KR) ..... 10-2010-0095328
Sep. 30, 2010 (KR) ..... 10-2010-0095329

(51) Int. Cl.
*E01D 19/12* (2006.01)
*E01D 2/02* (2006.01)
(Continued)

(52) U.S. Cl.
CPC ..... *E01D 19/125* (2013.01); *E01D 2/02* (2013.01); *E01D 19/12* (2013.01); *E04B 5/043* (2013.01); *E04B 5/10* (2013.01); *E04C 3/294* (2013.01)

(58) Field of Classification Search
CPC ..... E02D 2/00; E02D 2/02; E01D 19/125; E01D 19/12; E04B 5/043; E04B 5/10; E04C 3/294
USPC ..... 14/73, 73.1, 74.5
See application file for complete search history.

(56) References Cited

U.S. PATENT DOCUMENTS 4,710,994 A * 12/1987 Kishida et al. ..... 14/77.1
4,972,537 A * 11/1990 Slaw, Sr. ..... 14/77.1
(Continued)

FOREIGN PATENT DOCUMENTS

EP 275412 A2 * 7/1988 ..... E01D 19/04
JP 2008163705 A 7/2008
(Continued)

OTHER PUBLICATIONS

Korean Intellectual Property Office, International Search Report of PCT/KR2011/007205, WIPO, Apr. 13, 2012, 4 pages.

*Primary Examiner* — Abigail A Risic
(74) *Attorney, Agent, or Firm* — Alleman Hall McCoy Russell & Tuttle LLP

(57) ABSTRACT

The present disclosure relates to a floor slab structure for a bridge, the structure comprising: a girder-integrated floor slab having a girder member which is supported on a pier and supports a floor slab member, and which integrally protrudes from the lower surface of the floor slab member, multiple floor slab members being arranged to be connected in longitudinal and transverse directions; and a side barrier-integrated floor slab having a side bather member which integrally protrudes from the upper surface of one side of the floor slab member, multiple floor slab members being arranged to be connected in longitudinal and transverse directions. Accordingly, on-site work is minimized, the construction process for a bridge superstructure is simplified, the construction time period is shortened, the construction costs are significantly reduced, and the construction of skew bridges or curved bridges is simplified.

15 Claims, 13 Drawing Sheets

(51) Int. Cl.

| | |
|---|---|
| ***E04B 5/04*** | (2006.01) |
| ***E04B 5/10*** | (2006.01) |
| ***E04C 3/294*** | (2006.01) |

(56) References Cited

U.S. PATENT DOCUMENTS

| | | | | |
|---|---|---|---|---|
| 6,108,998 | A * | 8/2000 | Dumlao | 52/783.17 |
| 6,588,160 | B1 * | 7/2003 | Grossman | 52/223.7 |
| 8,266,751 | B2 * | 9/2012 | He | 14/77.1 |
| 8,341,788 | B2 * | 1/2013 | Kim et al. | 14/77.3 |
| 8,513,360 | B2 * | 8/2013 | Nosker et al. | 525/197 |
| 8,539,629 | B2 * | 9/2013 | Han | 14/74.5 |
| 8,689,383 | B2 * | 4/2014 | Han | 14/74.5 |
| 2009/0064610 | A1 * | 3/2009 | Ahn | 52/223.11 |
| 2011/0138549 | A1 * | 6/2011 | He | 14/73 |
| 2013/0104320 | A1 * | 5/2013 | Won | 14/74.5 |
| 2013/0269125 | A1 * | 10/2013 | Grace | 14/73 |

FOREIGN PATENT DOCUMENTS

| | | | |
|---|---|---|---|
| KR | 1020030021739 | A | 3/2003 |
| KR | 1020040105940 | A | 12/2004 |
| KR | 1020060055289 | A | 5/2006 |
| KR | 100783499 | B1 | 12/2007 |
| KR | 1020090045825 | A | 5/2009 |
| KR | 1020090089033 | A | 8/2009 |
| KR | 1020090105503 | A | 10/2009 |
| KR | 1020090122608 | A | 12/2009 |
| KR | 1020100025162 | A | 3/2010 |

* cited by examiner

FLOOR SLAB STRUCTURE FOR BRIDGE

TECHNICAL FIELD

The present disclosure relates generally to a floor slab structure for a bridge and, more particularly, to a floor slab structure for a bridge which can be easily assembled and constructed and makes construction of a skew bridge easier.

The present invention is the national phase application of International Application No. PCT/KR2011/007205, entitled Floor Slab Structure for Bridge, filed Sep. 29, 2011, which claims the benefit of Korean Patent Application No. 10-2010-0095328 filed on Sep. 30, 2010 and Korean Patent Application No. 10-2010-0095329 filed on Sep. 30, 2010. The patent applications identified above are incorporated herein by reference in their entirety for all purposes.

BACKGROUND ART

Generally, a bridge includes piers, girders which are spaced from each other in a widthwise direction of the bridge and connected to the piers at both their ends, and floor slabs formed on the girders.

Typically the floor slab is formed by installing the girders in a manner to be supported on and stretched between the piers, installing a mould for the floor slab on the girders, pouring concrete into the mould, and curing the concrete.

The bridge is also provided with side barriers which prevent vehicles running along the bridge from slipping off and falling down from the bridge.

Therefore, the construction process of the floor slab for a bridge is complicated and involves difficult work. Further, it takes a long time due to concrete placement and curing.

In addition, the work of constructing the floor slab for a bridge incurs a lot of labor costs, contributing to a large increase in the total cost of bridge construction.

Besides the cost problem, the above-described floor slab construction method has a more serious problem in that it is difficult to apply to construction of skew bridges, curved bridges, and the like.

That is, the side barriers are formed by installing moulds on site at both ends of the upper surface of the constructed floor slab after completing the construction of the floor slab, pouring concrete into the moulds, and curing the concrete. For this reason, the formation of the side barriers is another factor of increasing the time period for bridge construction.

Furthermore, since the side barriers cannot interact with the floor slab at all, the side barriers do not function as a structure which resists against an external load in the sense of dynamics but function as a structure which adds weight to the bridge.

DISCLOSURE

Technical Problem

Accordingly, the present disclosure has been made keeping in mind the above problems occurring in the prior art, and an object of the present disclosure is to provide a floor slab structure for a bridge which can reduce construction time period and cost of a bridge by simplifying the process of constructing a superstructure of a bridge, enables easy construction of a skew bridge by being easily assembled, and does not allow leakage of water by having an enhanced waterproof property.

Technical Solution

In order to accomplish the above object, the present disclosure provides a floor slab structure for a bridge which includes floor slab members which are connected to each other in longitudinal and transverse directions to form a floor slab for a bridge.

The floor slab member may have a transverse shear key which protrudes from one of both end surfaces in the longitudinal direction of the floor slab member, and a transverse shear key insertion hole, into which the transverse shear key is inserted, in the remaining end surface.

The transverse shear key insertion hole may be longer than the transverse shear key when measured in the longitudinal direction.

Both side ends of the floor slab member may be provided with side members, respectively which extend along longitudinal direction and protrude from a lower surface of the floor slab member, and the side members may be integrally formed with the floor slab member.

The floor slab structure for a bridge according to the present disclosure may further include lateral connecting beam members which are disposed at both end portions of the floor slab member in a lengthwise direction, integrally protrude from the lower surface of the floor slab member, and extend over a width of the floor slab member.

The floor slab structure for a bridge according to the present disclosure may further include a lateral reinforcing beam member which is disposed between the lateral connecting beam members, protrudes from the lower surface of the floor slab member, and extends over the width of the floor slab member.

The floor slab member may have multiple transverse steel wire insertion holes which extend through the floor slab member in the transverse direction.

In the floor slab member, a first longitudinal shear key protrudes from either one of a front surface of a front end and a rear surface of a rear end of the floor slab member, and a first shear key insertion hole, into which the first shear key is inserted, is formed in the remaining surface of the front surface and the rear surface.

The floor slab structure for a bridge according to the present disclosure may further include a sealing groove formed in an outer circumference of the floor sealing member, and a sealing member which is inserted in the sealing groove.

In the floor slab member according to the present disclosure, drainage grooves which extend in the lengthwise direction may be formed in both side surfaces of the floor sealing member, and located above and below the sealing grooves.

The floor slab structure for a bridge according to the present disclosure further includes a girder member which integrally protrudes from the lower surface of the floor slab member and is supported by a pier so as to support the floor slab member.

The girder member and the floor slab member may be made of concrete and integrally formed into one body.

The floor slab member may be made of concrete, and the girder member may be an H-shaped or I-shaped steel beam and integrated with the floor slab member by being fixed to the lower surface of the floor slab member.

The girder member may have multiple longitudinal steel wire insertion holes which extend through the girder member in the lengthwise direction, thereby applying pre-stress to the floor slab members connected in the longitudinal direction.

In the girder member, a second transverse shear key may protrude from either one of a front surface of a front end and a rear surface of a rear end of the girder member, and a second transverse shear key insertion hole, into which the second transverse shear key is inserted, may be formed in the remaining surface of the front surface and the rear surface.

The girder member may include a webbed portion protruding from the lower surface of the floor slab member, and a flange portion protruding from both sides of a lower end portion of the webbed portion in the longitudinal direction.

The floor slab structure for a bridge according to the present disclosure may further include a side barrier member which integrally protrudes from one end portion of the floor slab member.

The floor slab structure for a bridge according to the disclosure may further include a side barrier member which integrally protrudes from one end portion of the floor slab member.

The floor slab structure for a bridge according to the present disclosure includes a girder-integrated floor slab having a girder member which is supported on a pier which is located under the floor slab member and supports the floor slab member; and a side bather-integrated floor slab having a side barrier member which integrally protrudes from the upper surface of one side of the floor slab member, wherein multiple girder-integrated floor slabs are connected in the longitudinal direction and the transverse direction, and the side barrier-integrated floor slab is assembled with the girder-integrated floor slabs located on outermost sides out of the girder-integrated floor slabs connected in the transverse direction.

Advantageous Effects

As described above, the present disclosure has an advantage of allowing simultaneous installation of a girder and a floor slab or of a side barrier and the floor slab when constructing a bridge, thereby minimizing on-site work and simplifying the process of constructing a bridge superstructure. This greatly decreases the construction time period and cost.

Furthermore, the present disclosure has an advantage of simplifying the process of constructing, particularly, a skew bridge or a curved bridge, thereby decreasing the construction time period and cost for the skew bridge or curved bridge.

Still furthermore, the floor slab structure for a bridge according to the present disclosure has improved durability for resisting against a deflection load, and advantages of preventing leakage of water and enabling easy maintenance.

| * Brief Explanation of Reference Signs in Drawings * | |
|---|---|
| 1: Girder-integrated floor slab | 2: Side barrier-integrated floor slab |
| 10: Floor slab member | 20: Girder member |
| 30: Lateral connecting beam member | 40: Lateral reinforcing beam member |
| 60: Side barrier member | 70: Transverse shear key |
| 80: Transverse shear key insertion hole | |

BEST MODE

Preferred embodiments of the present disclosure will be described with reference to the accompanying drawings.

Figure 1:
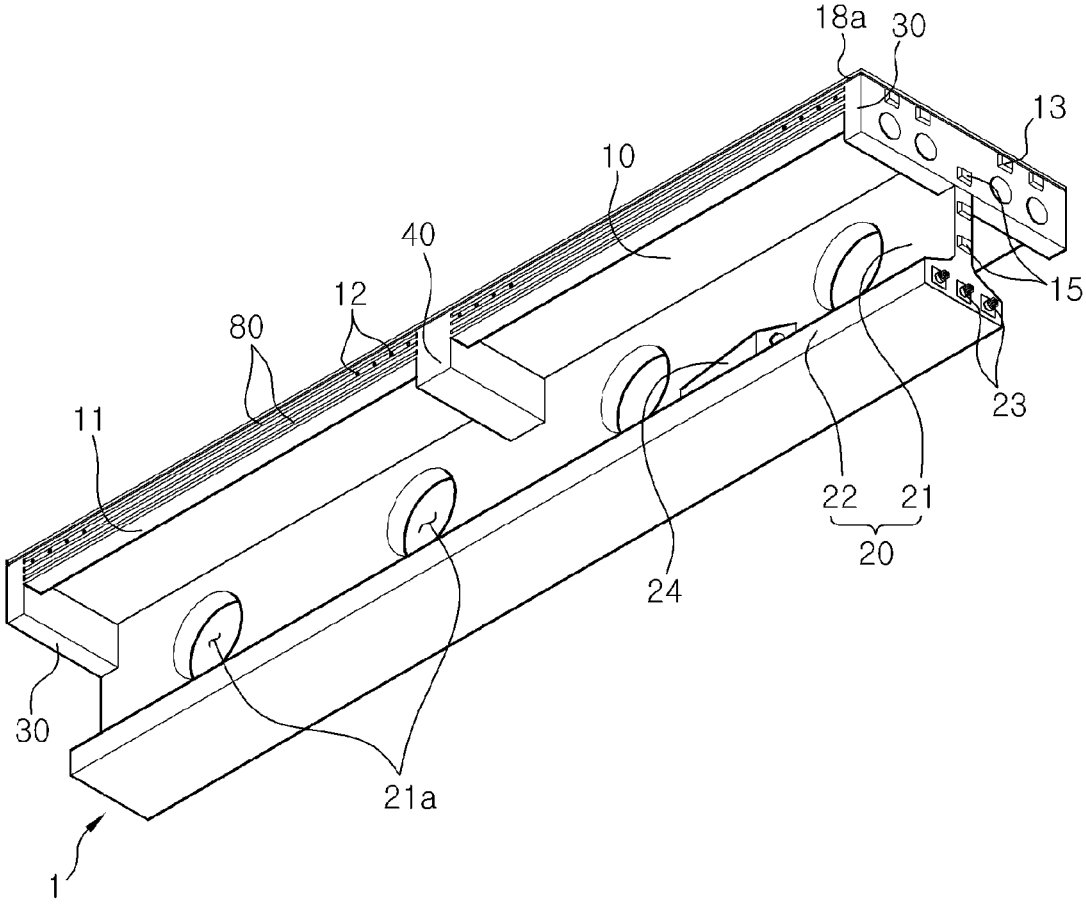
FIG. 1 is a perspective view illustrating a girder-integrated floor slab according to the present disclosure.

With reference to FIG. 1, a floor slab structure for a bridge according to the present disclosure includes floor slab members 10 which are arranged to be connected in longitudinal and transverse directions so as to form a floor slab for a bridge.

A girder member 20 is supported on a pier and integrally protrudes from the lower surface of the floor slab member 10.

The floor slab structure for a bridge according to the present disclosure includes a girder-integrated floor slab 1 in which the girder member 20 integrally protrudes from the lower surface of the floor slab member 10.

Figure 2:
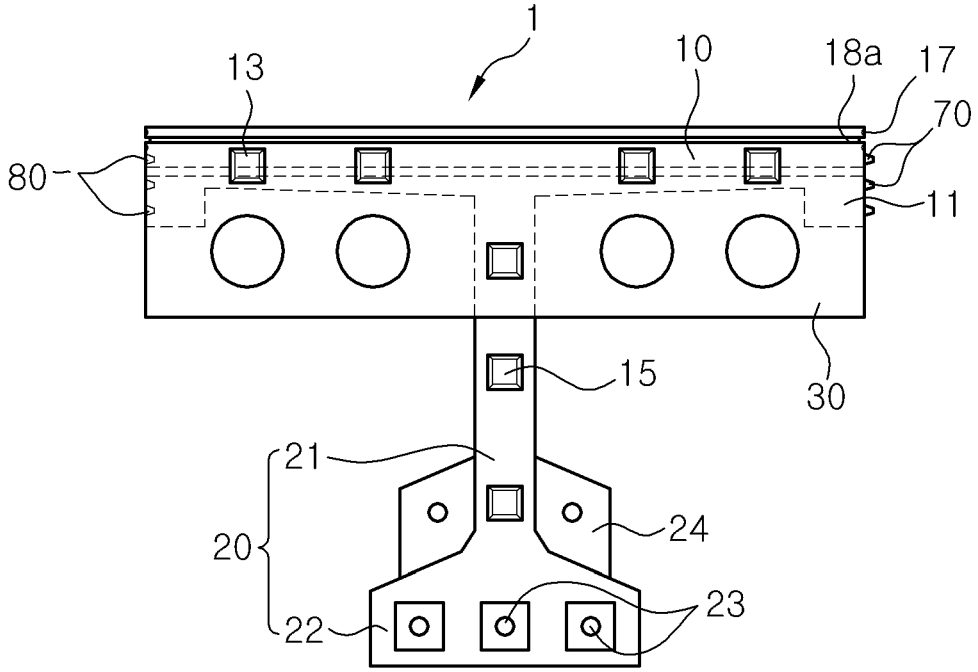
FIGS. 2 to 5 are front views illustrating various examples of the girder-integrated floor slab according to the present disclosure.

The girder-integrated floor slab 1 including the girder member 20 and the floor slab member 10 is integrally formed of concrete as illustrated in FIG. 2, and is mass-produced in various standard sizes from a manufacturing factory.

Figure 3:
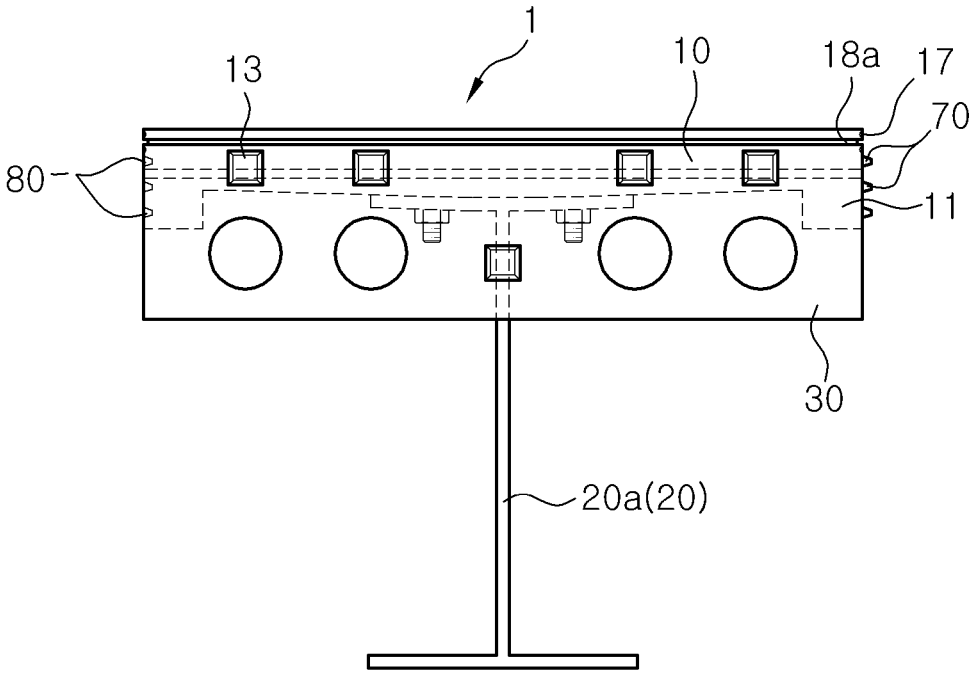

As illustrated in FIG. 3, the floor slab member 10 is made of concrete and the girder member 20 is an H-shaped or I-shaped steel beam 20*a*. The girder member 20 may be integrated with the floor slab member 10 by being attached or fixed to the lower surface of the floor slab member 10.

Figure 4:
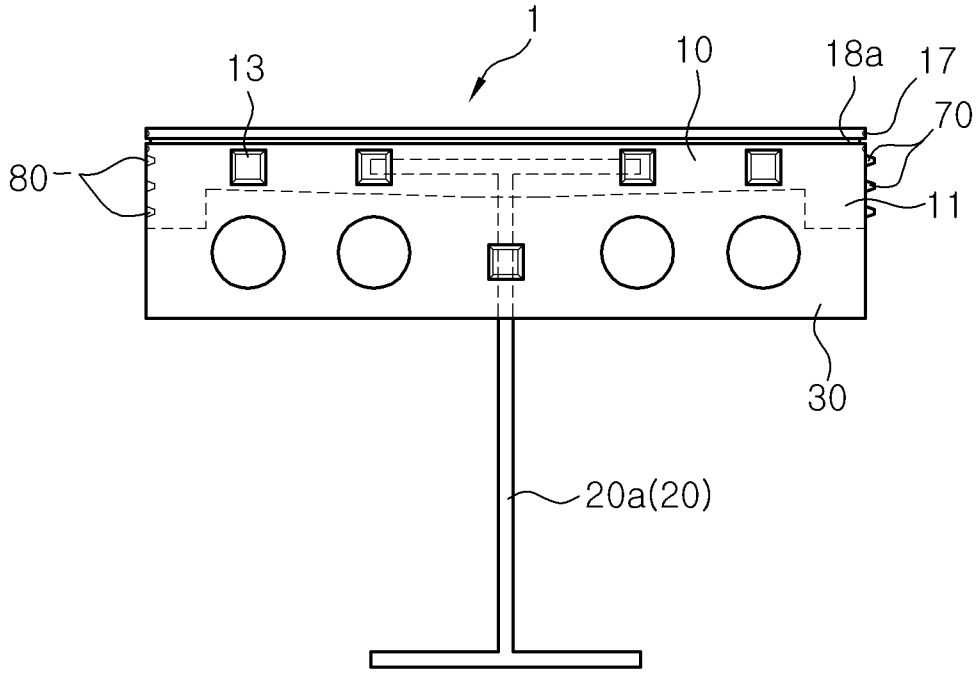

As illustrated in FIG. 4, the floor slab member 10 is made of concrete, the girder member 20 is the H-shaped or I-shaped steel beam 20*a*, and the girder member 20 may be integrated with the floor slab member 10 in a manner that an upper end portion, i.e., an upper flange of the girder member 20, is buried in the floor slab member 10.

When the girder member 20 is the H-shaped or I-shaped steel beam 20*a*, it is difficult to connect the girder members 20 to each other in the longitudinal direction using a shear key.

Figure 5:
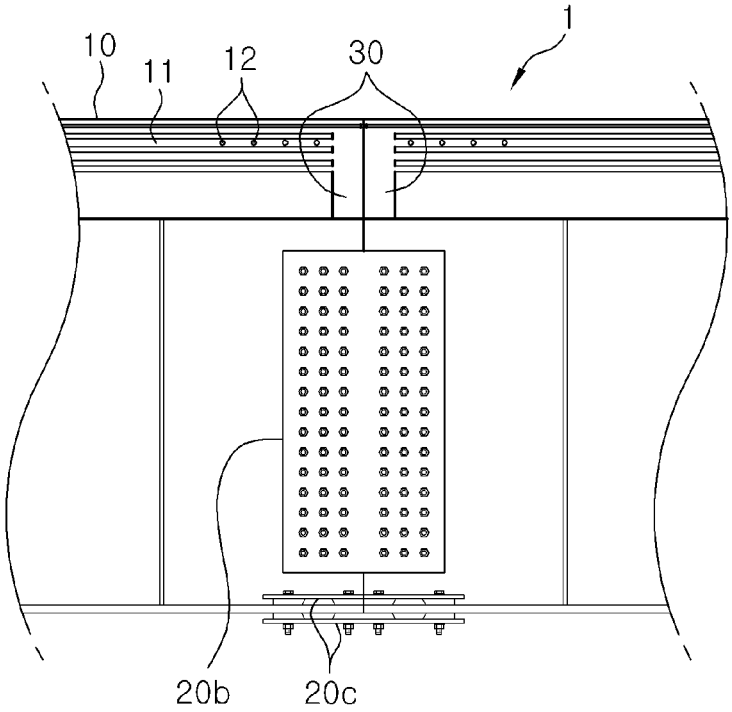

The steel beam 20*a*, as illustrated in FIG. 5, is superimposed on two webs which are in contact with each other and is connected to the webs using a first connection plate 20*b* which is in tight contact with the side surface of each web and combined with each web using a bolt.

In a portion of the steel beam 20*a* where two long flanges are combined, a second connection plate 20*c* is additionally provided. The second connection plate 20*c* is superimposed on the two lower flanges, is brought into tight contact with the upper and lower surfaces of the lower flanges, and is combined with the steel beam 20*a* so that the strength of the connected portion is increased.

Since the girder-integrated floor slab 1 is structured such that the girder and the floor slab are integrated into one body, the girder depth is reduced. Because of this, the girder-integrated floor slab 1 is advantageous in terms of cost and structural strength.

Since the girder-integrated floor slabs 1 in which the girder member 20 and the floor slab member 10 are integrated into one body are mass-produced in various standard sizes and structured to be able to be assembled with each other, the girder-integrated floor slabs 1 are simply chosen and assembled according to the design of a bridge. This simplifies the construction process of a bridge.

Furthermore, since the girder-integrated floor slab 1 has a structure in which the girder member 20 and the floor slab member 10 are integrated into one body, there is an advantage that the girder and floor slab for a bridge can be simultaneously installed by one construction process.

Moreover, since the girder-integrated floor slab 1 does not have a seam between the girder member 20 and the floor slab member 10, a problem of water leakage can be fundamentally prevented.

The girder member 20 includes a webbed portion 21 which vertically protrudes from the lower surface of the floor slab member 10 and is located at the center of the lower surface of the floor slab member 10, and a flange portion 22 which protrudes from both sides of a lower end of the webbed portion 21 in the longitudinal direction of the webbed portion 21.

The flange portion 22 has a flat and planar lower surface and is narrower in width than the floor slab member 10.

Figure 6:
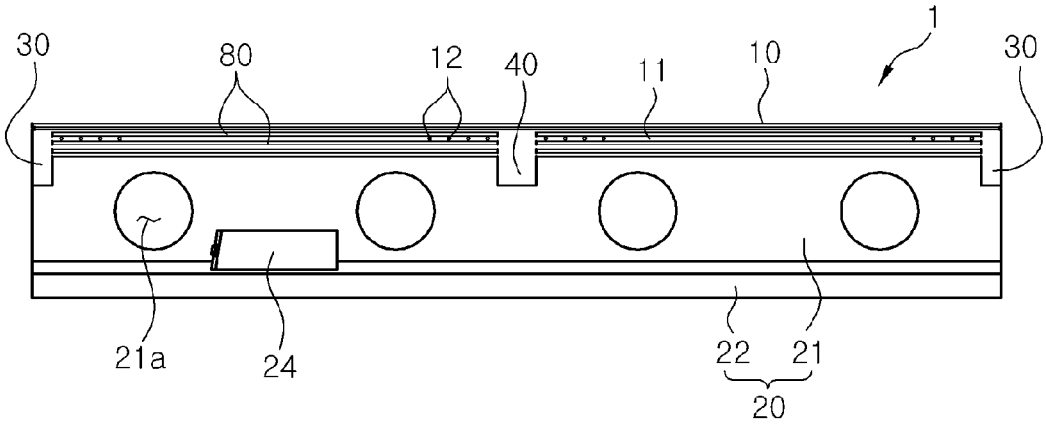
FIG. 6 is a side view illustrating the girder-integrated floor slab.

With reference to FIGS. 1 and 6, the webbed portion 21 has multiple hollows 21*a* which extend through the webbed portion 21 in the longitudinal direction. The hollows 21*a* are arranged to be distanced from each other. This structure preferably reduces the total weight of the girder-integrated floor slab 1.

Side members 11 are integrally formed with both side ends of the floor slab member 10. The side members 11 are formed to protrude from the lower surface of the floor slab member 10 and extend along the longitudinal direction of the floor slab member 10.

It is preferable that lateral connecting beam members 30 may be provided at both end portions of the floor slab member in the longitudinal direction. The lateral connecting beam members 30 may integrally protrude from the lower surface of the floor slab member 10 and may be arranged to extend over a width of the floor slab member 10.

The lateral connecting beam members 30 are connected to each other when the multiple floor slab members 10 are connected to each other in the longitudinal direction, i.e., in the lengthwise direction. In this structure, the contact surface area of the connected portion is increased, resulting in improved durability.

The lateral connecting beam members 30 increases the strength of the floor slab member 10 and the strength of the girder member 20, i.e., the strength of the webbed portion 21, and also increases the strength of the connected portion between the floor slab member 10 and the webbed portion 21.

A lateral reinforcing beam member 40 is provided at a center portion of the floor slab member 10 and formed to integrally protrude from the lower surface of the floor slab member 10. The lateral reinforcing beam member 40 extends over a width of the floor slab member 10 and is disposed between the lateral connecting beam members 30.

The lateral reinforcing beam member 40 increases not only the strength of the floor slab member 10 but also the strength of the girder member 20, i.e., the strength of the webbed portion 21. The lateral reinforcing beam member 40 especially increases the strength of the connected portion between the floor slab member 10 and the webbed portion 21. That is, the durability of the entire floor slab structure, including the girder-integrated floor slab 1, is improved by the lateral reinforcing beam member 40.

The lateral connecting beam members 30 and the lateral reinforcing beam member 40 are integrally formed with the floor slab member 10 and the girder member 20. The lateral connecting beam members 30 and the lateral reinforcing beam member 40 are combined with the floor slab member 10 and the girder member 20 when multiple floor slab structures, including the girder-integrated floor slab 1, are connected to each other in the transverse direction, so that the strength of the floor slab members 10 is increased. Furthermore, since this method eliminates the installation process of lateral beams, the total construction time period is remarkably shortened and the construction cost is reduced.

The side members 11 increase the strength of the connected portion between the floor slabs when the floor slab structures, including the girder-integrated floor slab 1, are connected to each other in the transverse direction, and also increase the deflection strength which resists the downward load which is applied from above the floor slab member 10.

It is preferable that steel wire anchorages 24, which can anchor a pre-stressing steel wire to the bottom of the webbed portion 21, are provided at both side surfaces of the webbed portion 21, respectively.

The steel wire anchorages 24 enable application of pre-stressing at the middle portion of a bridge which is constructed using the floor slab structure according to the disclosure.

The girder member 20 has multiple longitudinal steel wire insertion holes 23 which extend through the girder member 20 in the longitudinal direction so that the floor slab structures for a bridge according to the present disclosure, which are connected to each other in the transverse direction, are pre-stressed.

Pre-stressing steel wires are inserted to pass through the longitudinally-extended steel wire insertion holes 23, and sheath tubes, in which the steel wire anchorages 24 are installed, may be inserted into end portions of the steel wire insertion holes 23.

The pre-stressing steel wires are installed to pass through the longitudinally-extended steel wire insertion holes 23. In this way, the multiple floor slab members 10 which are connected to each other in the transverse direction can be placed in tighter contact with each other and be more securely combined. Moreover, this also dramatically increases the strength of resisting the deflection or shear stress, which is exerted in the longitudinal direction of the girder member 20 due to the load applied from above the floor slab member 10, by the pre-stress which occurs in the longitudinal direction.

It is preferable that the floor slab member 10 further has multiple transversely-extended steel wire insertion holes 23 which extend through the floor slab member 10 and pass through both ends of the floor slab member 10 in the longitudinal direction.

The transversely-extended steel wire insertion holes 12 communicate with each other when the floor slab structures, including the girder-integrated floor slab 1, are connected to each other in the transverse direction, and pre-stressing steel wires pass through the transversely-extended steel wire insertion holes 12.

The pre-stressing steel wires are installed to pass through the transversely-extended steel wire insertion holes 12 so that the multiple floor slab members 10 connected in the transverse direction can be placed in tighter contact with each other and more securely combined with each other. Moreover, this also dramatically increases the strength of resisting the deflection or shear stress, which is exerted in the widthwise direction of the floor slabs 10 due to the load applied from above the floor slab member 10, by the pre-stress which occurs in the widthwise direction.

The girder-integrated floor slabs 1 are connected to each other by an assembly method in a manner of inserting the pre-stressing steel wires into the longitudinally-extended steel wire insertion holes 23 and the transversely-extended steel wire insertion holes in the longitudinal direction and the transverse direction. Because of this, the floor slab structure can be constructed by dry assembly without performing on-site concrete placement, and the strength of the bridge superstructure can be guaranteed.

In addition, a first longitudinal shear key 13 protrudes from one of the front surface of the front end or the rear surface of the rear end of the floor slab member 10, and a first longitudinal shear key insertion hole is formed in the other surface of the front surface and the rear surface.

In addition, a second longitudinal shear key 15 protrudes from either one of the front surface of the front end or the rear surface of the rear end of the girder member 20, and a second longitudinal shear key insertion hole is formed in the other surface of the front surface and the rear surface.

The girder-integrated floor slabs 1 are connected to each other in the longitudinal direction by inserting the first longitudinal shear key 13 and the second longitudinal shear key 15 of one girder-integrated floor slab 1 into the first longitudinal shear key insertion hole 14 and the second longitudinal shear key insertion hole 16 of another girder-integrated floor slab 1, respectively.

A transverse shear key 70 protrudes from one of the surfaces of both ends of the floor slab member 10 in the longitudinal direction, and a transverse shear key insertion hole 80 into which the transverse shear key 70 is inserted is formed in the other surface of the surfaces of both ends.

It is preferable that the transverse shear key 70 and the transverse shear key insertion hole 80 are formed in multiple numbers, and arranged on the side surfaces 11 in a manner to be distanced from each other. In this way, the load can be distributed.

Figure 7:
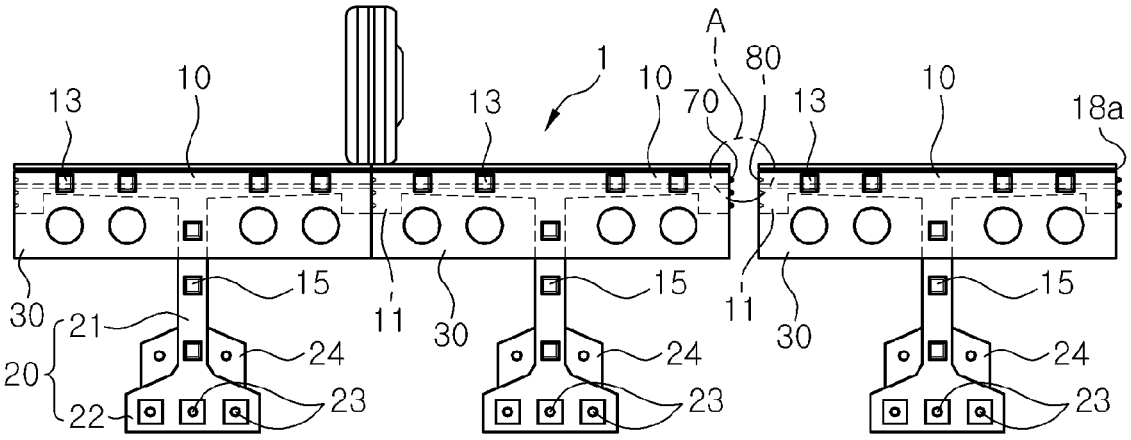
FIG. 7 is a schematic view illustrating an assembled state of the girder-integrated floor slab.

As illustrated in FIG. 7, the floor slab structures are continuously connected to each other in the transverse direction by inserting the transverse shear keys 70 of one floor slab structure, including the girder-integrated floor slab 1, into the transverse key insertion holes 80 of another floor slab structure, including the girder-integrated floor slab 1.

The floor slab member 10 is provided with side members 11 which are provided at both ends of the floor slab member 10 in the longitudinal direction and extend from the side surfaces to the lower surface. One of the opposing side members 11 is provided with the transverse shear keys 70 which are arranged along the height direction. The other side member 11 is provided with the transverse shear key insertion holes 80 which are arranged along the height direction so as to correspond to the transverse shear keys 70. Because of this, when the wheels of a vehicle are located at the connected portion between the floor slabs and the direct load is applied to the connected portion, the strength of the sectional surfaces at the connected portion is increased and sagging is prevented.

Figure 8:
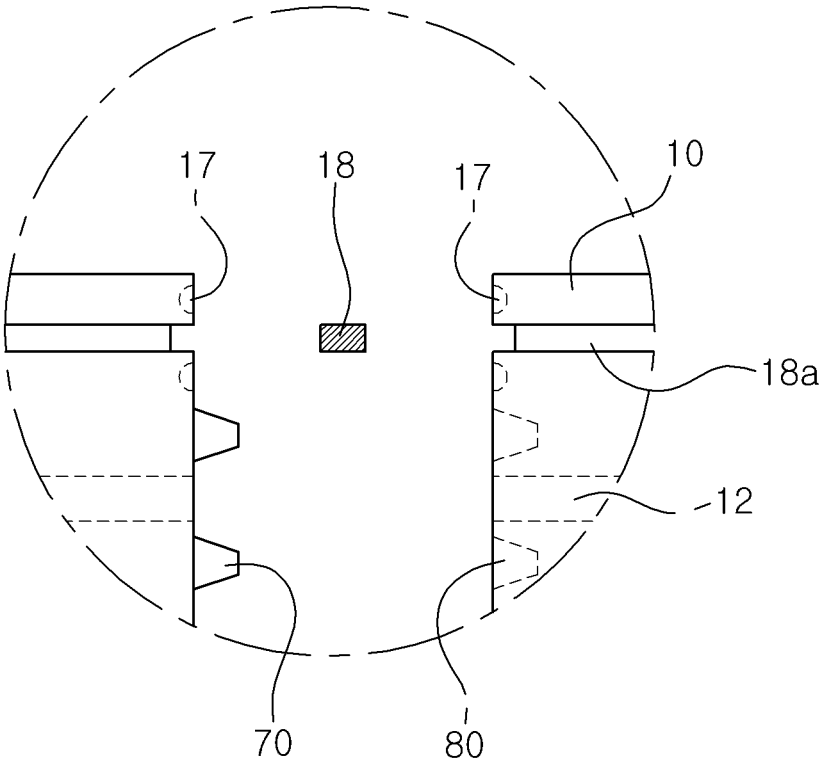
FIG. 8 is an enlarged view illustrating a portion A in FIG. 7.

With reference to FIG. 8, it is preferable that the external side surfaces, including surfaces of both sides, the front surface of the front end, and the rear surface of the rear end, are provided with a sealing groove 18*a*. In addition, it is preferable that the floor slab structure including the girder-integrated floor slab 1 is provided with a sealing member 18 which is inserted into the sealing groove 18*a*.

The sealing member 18 prevents water from flowing from the upper surface to the lower surface of the floor slab member 10, thereby preventing leakage of water.

Both side surfaces of the floor slab member 10 are provided with drainage grooves 17 guiding water to be drained. The drainage grooves 17 are formed above and below the sealing groove 18*a* in a manner to extend along the longitudinal direction.

When water attempts to flow from the upper surface to the lower surface of the floor slab member 10, the drainage grooves 17 guide the flow of water along the longitudinal direction of the floor slab member 10 up to both ends of the bridge so that the water is discharged from both ends of the bridge. That is, the drainage grooves 17 prevent water from leaking through a gap in the connected portion of the floor slab members 10.

In the case of the typical assembly-type floor slab structures in which the girder and the floor slab are not integrated, unlike the girder-integrated floor slab 1, the floor slab structures can be connected in only one direction of the longitudinal direction or the transverse direction. In addition, when the typical assembly-type floor slab structures are connected, a wet connection process of using concrete placement or mortar is usually used. This causes problems that a lot of on-site work has to be performed and water leakage generally occurs at each connected portion.

Since the girder-integrated floor slabs 1 are connected in the longitudinal and transverse directions to form a floor slab structure by an assembly method, the girder and the floor slab can be simultaneously installed at the time of constructing a bridge in a simple manner.

The girder-integrated floor slabs 1 are continuously connected to each other in the longitudinal and transverse directions by inserting the first longitudinal shear key 13 and the second longitudinal shear key 15 of one girder-integrated floor slab 1 into the first longitudinal shear key insertion hole 14 and the second longitudinal shear key insertion hole 16 of another girder-integrated floor slab 1, respectively, and inserting the transverse shear key 70 of one girder-integrated floor slab 1 into the transverse shear key insertion hole 80 of another girder-integrated floor slab 1.

Figure 9:
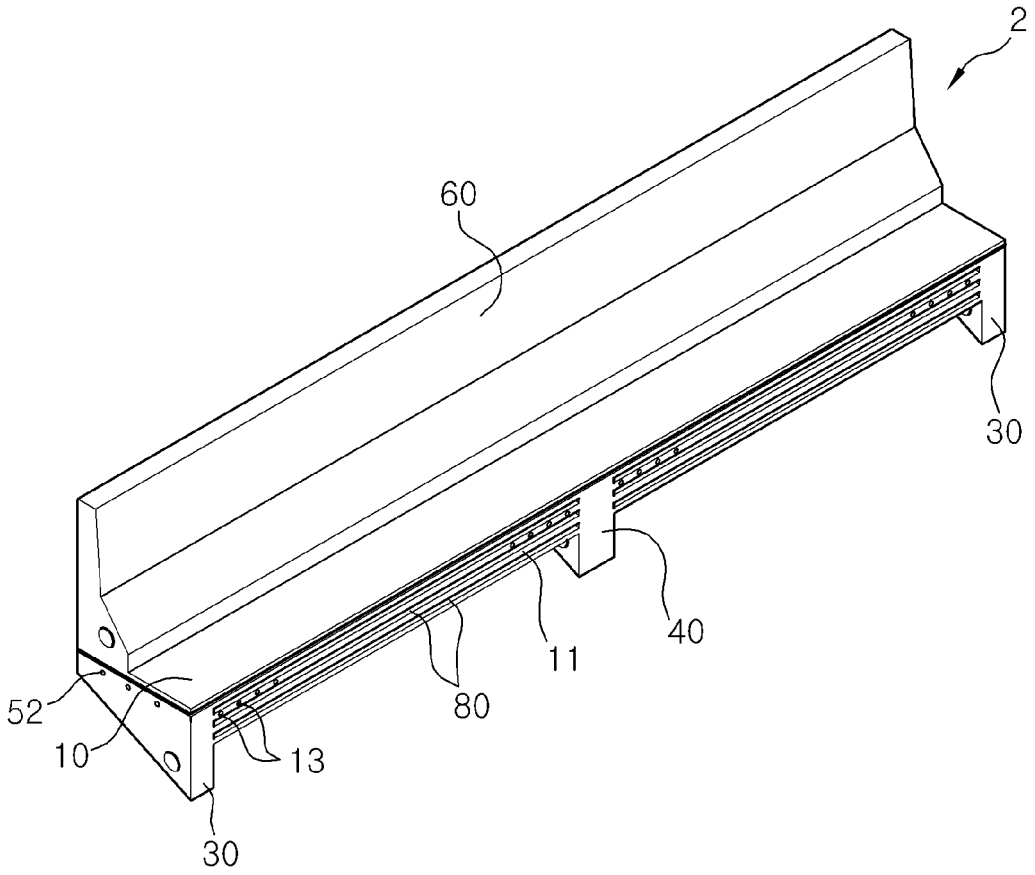
FIG. 9 is a perspective view illustrating a side barrier-integrated floor slab according to the present disclosure.
Figure 10:
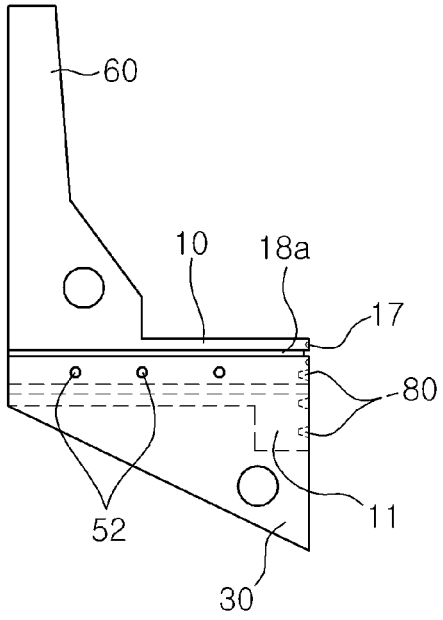
FIG. 10 is a front view illustrating the side barrier-integrated floor slab according to the present disclosure.
Figure 11:
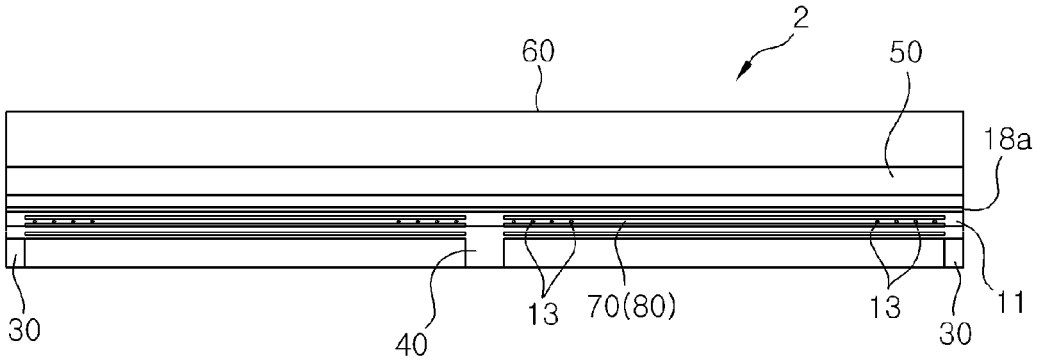
FIG. 11 is a side view illustrating the side barrier-integrated floor slab according to the present disclosure.

With reference to FIGS. 9 to 11, the floor slab structure for a bridge according to the present disclosure includes a side bather member 60 which is integrally formed with the floor slab member 10 and protrudes from one end of the floor slab member 10.

The side bather member 60 is made of concrete and is integrally formed with the floor slab member 10.

The floor slab structure for a bridge according to the present disclosure includes a side bather-integrated floor slab 2 in which the side bather member 60 integrally protrudes from one end of the floor slab member 10.

The side barrier-integrated floor slab 2 is structured such that one end of a floor slab member 10 is connected to one end of another floor slab member 10 and the side bather member 60 integrally protrudes from the remaining end of the floor slab member 10.

In the side barrier-integrated floor slab 2, the remaining end of the floor slab member 10 is provided with the transverse shear key 70 or the transverse shear key insertion hole 80, so the floor slab member 10 of one floor slab structure is connected to the floor slab member 10 of another floor slab structure.

For example, the side bather-integrated floor slab 2 made of concrete has an integrated structure, and it can also be mass-produced in various standard sizes.

If the side barrier is integrally formed with the floor slab like the side barrier-integrated floor slab 2, since L-shaped structures are applied as the floor slabs which are located at both ends of a bridge, both of the floor slab and the side bather resist against the external load in the sense of dynamics, so the bridge has an advantage in terms of structural strength.

That is, the side barrier functions not only as a structure which prevents vehicles from slipping off or falling down from the bridge, but also as a structure which resists against the external load together with the floor slab.

Since the side barrier-integrated floor slabs 2 can be mass-produced in various standard sizes in the form that the fire wall member 60 and the floor slab member 10 are integrated into one body, and are structured to be able to be connected to the floor slab member 10 of the girder-integrated floor slab 1, the floor slabs 1 and 2 can be simply chosen and assembled. This simplifies the construction process of a bridge.

In addition, since the side barrier-integrated floor slab 2 is structured such that the floor slab member 10 and the side barrier member 60 are integrated into one body, there is an advantage that the floor slab for a bridge and the side barrier can be simultaneously installed by one installation process.

Furthermore, the side bather-integrated floor slab 2 does not have a seam between the floor slab member 10 and the side barrier member 60, so a problem of water leakage can be fundamentally prevented.

The floor slab member 10 of the side barrier-integrated floor slab 2 includes lateral connecting beam members 30 and a lateral reinforcing beam member 40.

The lateral connecting beam members 30 and the lateral reinforcing beam member 40 increase the strength of the floor slab member 10 of the side bather-integrated floor slab 2 and the strength of the floor slab 10 of the girder-integrated floor slab 1 when the multiple girder-integrated floor slabs 1 and the multiple side barrier-integrated floor slabs 2 are connected. Furthermore, since the lateral connecting beam members 30 and the lateral reinforcing beam members 40 eliminate an on-site lateral beam installation process, the construction time period can be remarkably shortened and the construction cost can be reduced.

A finishing floor slab member 50 of the side bather-integrated floor slab 2 has multiple first steel wire insertion holes 52 which extend through the finished floor slab member 50 in the longitudinal direction, i.e., the lengthwise direction, and are arranged to be distanced from each other in the widthwise direction. The finishing floor slab member 50 further has transverse steel wire insertion holes 12.

The first steel wire insertion holes 52 communicate with each other when the multiple floor slab members 10 are connected to each other in the longitudinal direction, and pre-stressing steel wires are inserted to pass through the first steel wire insertion holes 52.

As the pre-stressing steel wires pass through the multiple first steel wire insertion holes 52 which are made to communicate with each other, the floor slab members 10 are placed in tighter contact with each other and are more securely combined with each other by dry assembly, without performing on-site work of concrete placement.

The pre-stressing steel wires remarkably increase the strength which resists against the deflection or shear stress exerted in the lengthwise direction of the floor slab member 10 due to the load applied from above the floor slab member 10 by the pre-stressing.

It is preferable that the floor slab member 10 of the side barrier-integrated floor slab 2 includes a side member 11 which is integrally formed with the floor slab member 10 and extends from one side surface of the floor slab member 10 to the lower surface. The side member 11 is used to connect the floor slab member 10 of the side bather-integrated floor slab 2 to the floor slab member 10 of the girder-integrated floor slab 1.

Transverse shear keys 70 protrude from the side member 11 so as to enable connection with another floor slab member 10, or transverse shear key insertion holes 80, into which the transverse shear keys 70 are inserted, are formed in the side member 11 to enable connection with the floor slab member 10 of the girder-integrated floor slab 1.

Since the side member 11 increases the contact surface area at the connected portion when the floor slab members 10 are connected to each other in the transverse direction, the strength of the sectional surfaces of the connected portion is increased and sagging at the connected portion is prevented when the wheels of a vehicle are located at the connected portion and thus a direct load is applied to the connected portion.

Figure 12:
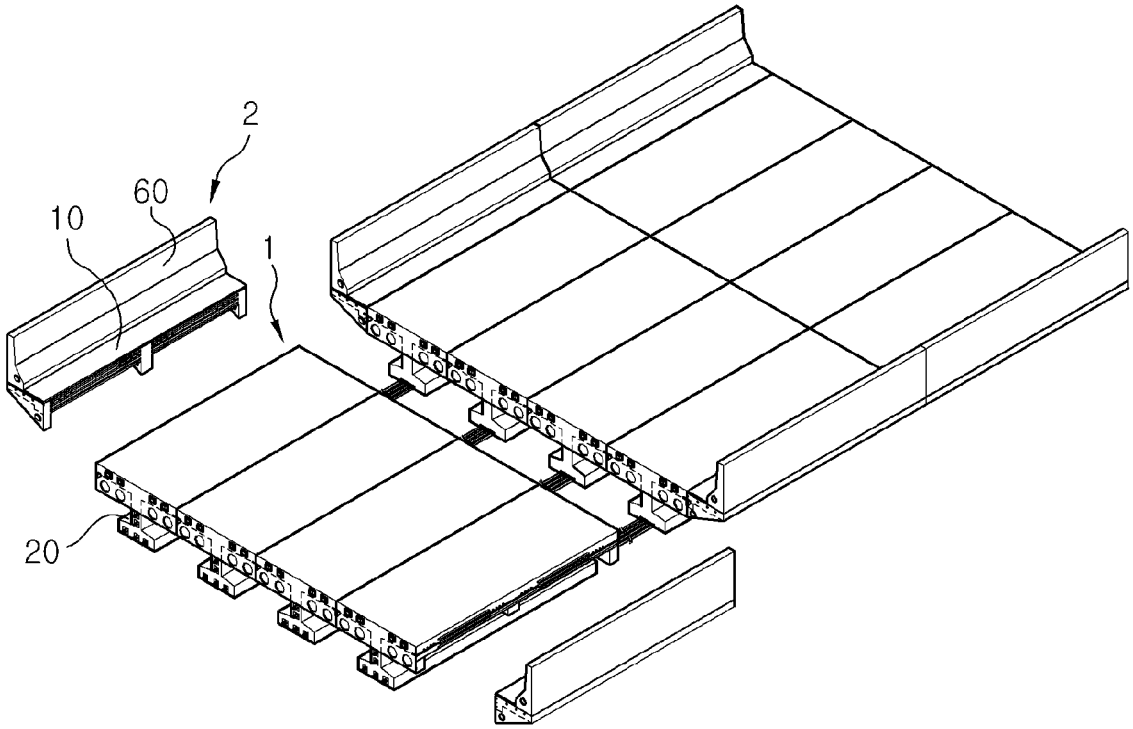
FIGS. 12 and 13 are diagrams illustrating examples of assembling the girder-integrated floor slab according to the present disclosure and assembling the side barrier-integrated floor slab according to the present disclosure, respectively.
Figure 13:
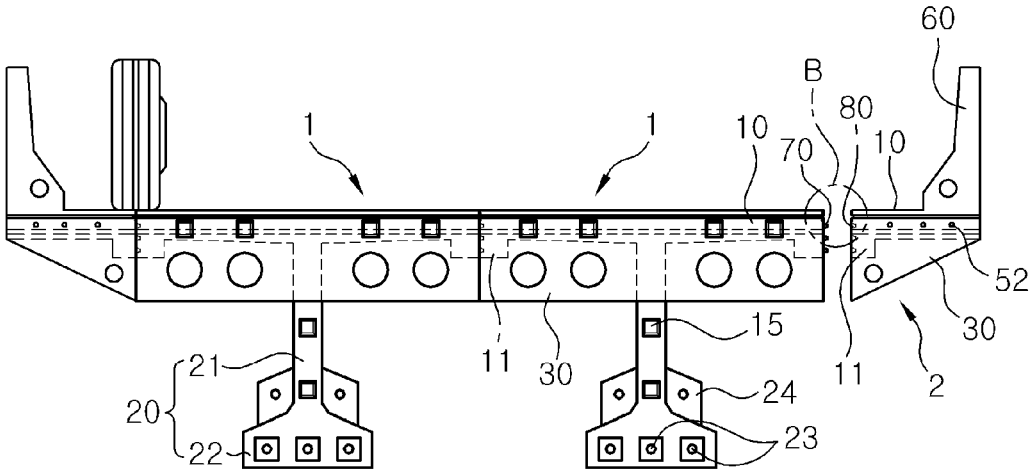

With reference to FIGS. 12 and 13, the floor slab structure for a bridge according to the present disclosure is completed by connecting the multiple girder-integrated floor slabs 1 in the longitudinal direction and the transverse direction to form a floor slab for a bridge, and connecting the multiple side barrier-integrated floor slabs 2 to ends of the previously formed floor slab by an assembly method.

Figure 14:
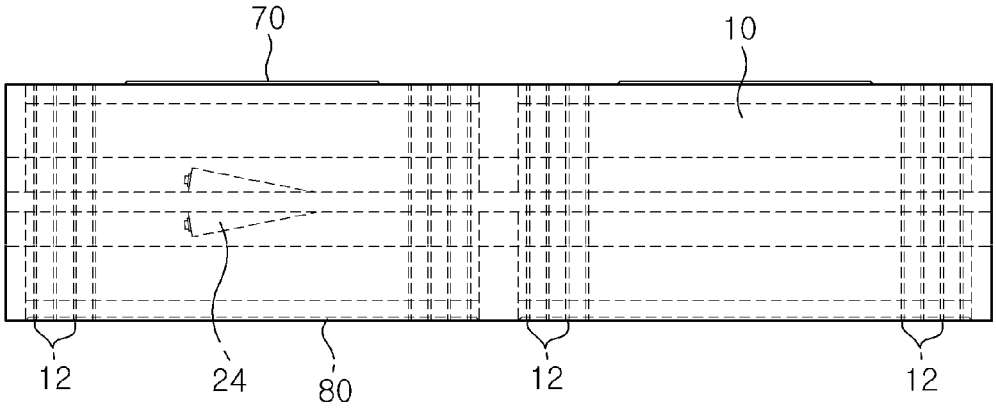
FIG. 14 is a plan view of the girder-integrated floor slab according to the present disclosure.
Figure 15:
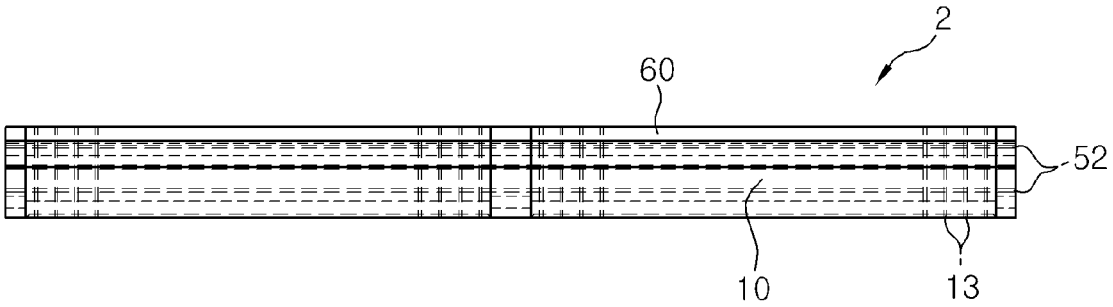
FIG. 15 is a plan view of the side barrier-integrated floor slab according to the present disclosure.

With reference to FIGS. 14 and 15, it is preferable that the transverse shear key insertion hole 80 which is used to connect the floor slab members 10 to each other in the transverse direction is longer than the transverse shear key 70 in the lengthwise direction of the floor slab member 10.

Figure 16:
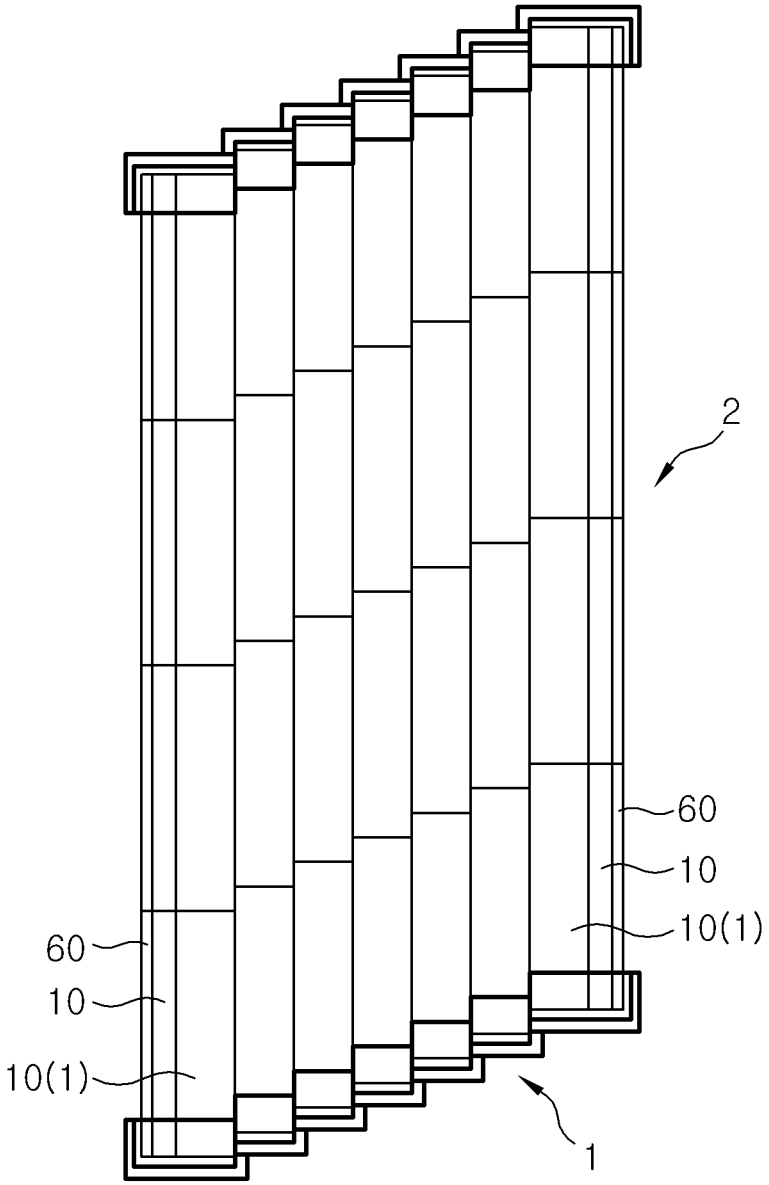
FIG. 16 is a plan view illustrating a skew bridge which is constructed by using the girder-integrated floor slab and the assembled side barrier-integrated floor slab according to the present disclosure.

In the floor slab structure for a bridge according to the present disclosure, as illustrated in FIG. 16, the multiple girder-integrated floor slabs 1 and the side bather-integrated floor slabs 2 are not aligned with each other but are misaligned to be arranged in a shifted manner in the lengthwise direction when the multiple girder-integrated floor slabs 1 and the side barrier-integrated floor slabs 2 are connected to each other in the transverse direction. This arrangement enables construction of a skew bridge. This arrangement enables and facilitates even construction of a curved bridge if the length of a cantilever of the side barrier-integrated floor slab 2 is adjusted.

The present disclosure may not limited to the above-described embodiments, but may be diversely modified, altered, or changed without departing from the spirit of the disclosure. Such modifications, additions, and substitutions will fall within the scope of the disclosure.

What is claimed is:

1. A floor slab structure for a bridge, comprising:

floor slab members being arranged to be connected to each other in longitudinal and transverse directions to form a floor slab for a bridge;

side members formed at both side ends of the floor slab member in a manner to extend along a lengthwise direction of the floor slab member and protrude from a lower surface of the floor slab member;

lateral connecting beam members which are disposed at both end portions of the floor slab member in a lengthwise direction, integrally protrude from the lower surface of the floor slab member, and extend over a width of the floor slab member; and a girder member which integrally protrudes from the lower surface of the floor slab member and is supported on a pier so as to support the floor slab member.

2. The floor slab structure for a bridge as set forth in claim 1, wherein the floor slab member includes a transverse shear key which protrudes from one of both end surfaces of the floor slab member in the longitudinal direction and a transverse shear key insertion hole in the remaining end surface.

3. The floor slab structure for a bridge as set forth in claim 2, wherein the transverse shear key insertion hole is longer than the transverse shear key in the lengthwise direction of the floor slab member.

4. The floor slab structure for a bridge as set forth in claim 1, further comprising a lateral reinforcing beam member which is disposed between the lateral connecting beam members, protrudes from the lower surface of the floor slab member, and extends over the width of the floor slab member.

5. The floor slab structure for a bridge as set forth in claim 1, wherein the floor slab member has multiple transverse steel wire insertion holes which extend through the floor slab member in the transverse direction.

6. The floor slab structure for a bridge as set forth in claim 1, wherein a first longitudinal shear key protrudes from either one of a front surface of a front end and a rear surface of a rear end of the floor slab member, and a first shear key insertion hole, into which the first shear key is inserted, is formed in a remaining surface of the front surface and the rear surface.

7. The floor slab structure for a bridge as set forth in claim 1, wherein the floor slab member has a sealing groove in an outer circumference, and further comprising a sealing member which is inserted in the sealing groove.

8. The floor slab structure for a bridge as set forth in claim 7, wherein drainage grooves which extend in the lengthwise direction are formed in both side surfaces of the floor sealing member, and the drainage grooves are formed above and below the sealing groove.

9. The floor slab structure for a bridge as set forth in claim 1, wherein the girder member and the floor slab member are made of concrete and are integrally formed into one body.

10. The floor slab structure for a bridge as set forth in claim 1, wherein the floor slab member is made of concrete, and the girder member is an H-shaped or I-shaped steel beam and is integrated with the floor slab member by being fixed to the lower surface of the floor slab member.

11. The floor slab structure for a bridge as set forth in claim 1, wherein the girder member has multiple longitudinal steel wire insertion holes which extend through the girder member in the lengthwise direction, thereby applying pre-stress to the floor slab members connected in the longitudinal direction.

12. The floor slab structure for a bridge as set forth in claim 6, wherein a second longitudinal shear key protrudes from either one of a front surface of a front end and a rear surface of a rear end of the girder member, and a second longitudinal shear key insertion hole, into which the second longitudinal shear key is inserted, is formed in a remaining surface of the front surface and the rear surface.

13. The floor slab structure for a bridge as set forth in claim 1, wherein the girder member includes a webbed portion which protrudes from the lower surface of the floor slab member, and a flange portion which protrudes from both sides of a lower end portion of the webbed portion in a longitudinal direction.

14. The floor slab structure for a bridge as set forth in claim 1, further comprising a side barrier member which integrally protrudes from one end portion of the floor slab member.

15. The floor slab structure for a bridge according to claim 1, comprising:

a girder-integrated floor slab including a girder member which is supported on a pier located under the floor slab member and which supports the floor slab member; and a side barrier-integrated floor slab including a side barrier member which integrally protrudes from an upper surface of one side of the floor slab member, wherein a plurality of the girder-integrated floor slabs are connected to each other in the longitudinal direction and the transverse direction, and the side barrier-integrated floor slab is assembled with an outermost girder-integrated floor slab out of the plurality of girder-integrated floor slabs connected in the transverse direction.

* * * * *

UNITED STATES PATENT AND TRADEMARK OFFICE

CERTIFICATE OF CORRECTION

PATENT NO. : 9,249,546 B2
APPLICATION NO. : 13/877146
DATED : February 2, 2016
INVENTOR(S) : Man-Yop Han It is certified that error appears in the above-identified patent and that said Letters Patent is hereby corrected as shown below:

On the title page item (57) line 8,

In the Abstract, delete "bather" and insert --barrier--.

Signed and Sealed this
Second Day of August, 2016

Michelle K. Lee

Michelle K. Lee
*Director of the United States Patent and Trademark Office*